US007945175B2

(12) United States Patent
Amann et al.

(10) Patent No.: US 7,945,175 B2
(45) Date of Patent: May 17, 2011

(54) TONER CONTAINER STRUCTURE AND METHOD FOR ASSESSING TONER CONSUMPTION IN AN IMAGE FORMING APPARATUS

(75) Inventors: Mark Willaim Amann, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 249 days.

(21) Appl. No.: 12/277,568

(22) Filed: Nov. 25, 2008

(65) Prior Publication Data

US 2010/0129091 A1 May 27, 2010

(51) Int. Cl.
*G03G 15/08* (2006.01)

(52) U.S. Cl. ..... 399/27; 399/258

(58) Field of Classification Search ..... 399/258, 399/262, 27, 43

See application file for complete search history.

(56) References Cited

U.S. PATENT DOCUMENTS

| | | | | |
|---|---|---|---|---|
| 5,655,174 | A * | 8/1997 | Hirst | 399/27 |
| 5,797,061 | A | 8/1998 | Overall et al. | |
| 5,802,420 | A | 9/1998 | Garr et al. | |
| 6,510,291 | B2 | 1/2003 | Campbell et al. | |
| 6,600,882 | B1 | 7/2003 | Applegate et al. | |
| 6,718,147 | B1 | 4/2004 | Carter et al. | |
| 7,389,072 | B2 | 6/2008 | Hebner et al. | |
| 2001/0016122 | A1 * | 8/2001 | Arima | 399/27 |
| 2008/0080878 | A1 * | 4/2008 | Tanaka et al. | |
| 2009/0136244 | A1 * | 5/2009 | Lim | 399/27 |

FOREIGN PATENT DOCUMENTS

JP 2008026844 A * 2/2008

* cited by examiner

*Primary Examiner* — Susan S Lee

(57) ABSTRACT

The present invention provides a toner container system (such as a toner cartridge) and method for determining the toner consumed by each pixel in an image forming apparatus, such as a printer, so to accurately assess the amount of toner remaining in the toner container. The pixels printed by the image forming apparatus are counted over a portion of toner container life when a known amount of toner is consumed, the rate of toner consumption per pixel is then calculated, and the calculated rate of toner consumption per pixel is used to determine the amount of toner remaining in the container system.

20 Claims, 1 Drawing Sheet

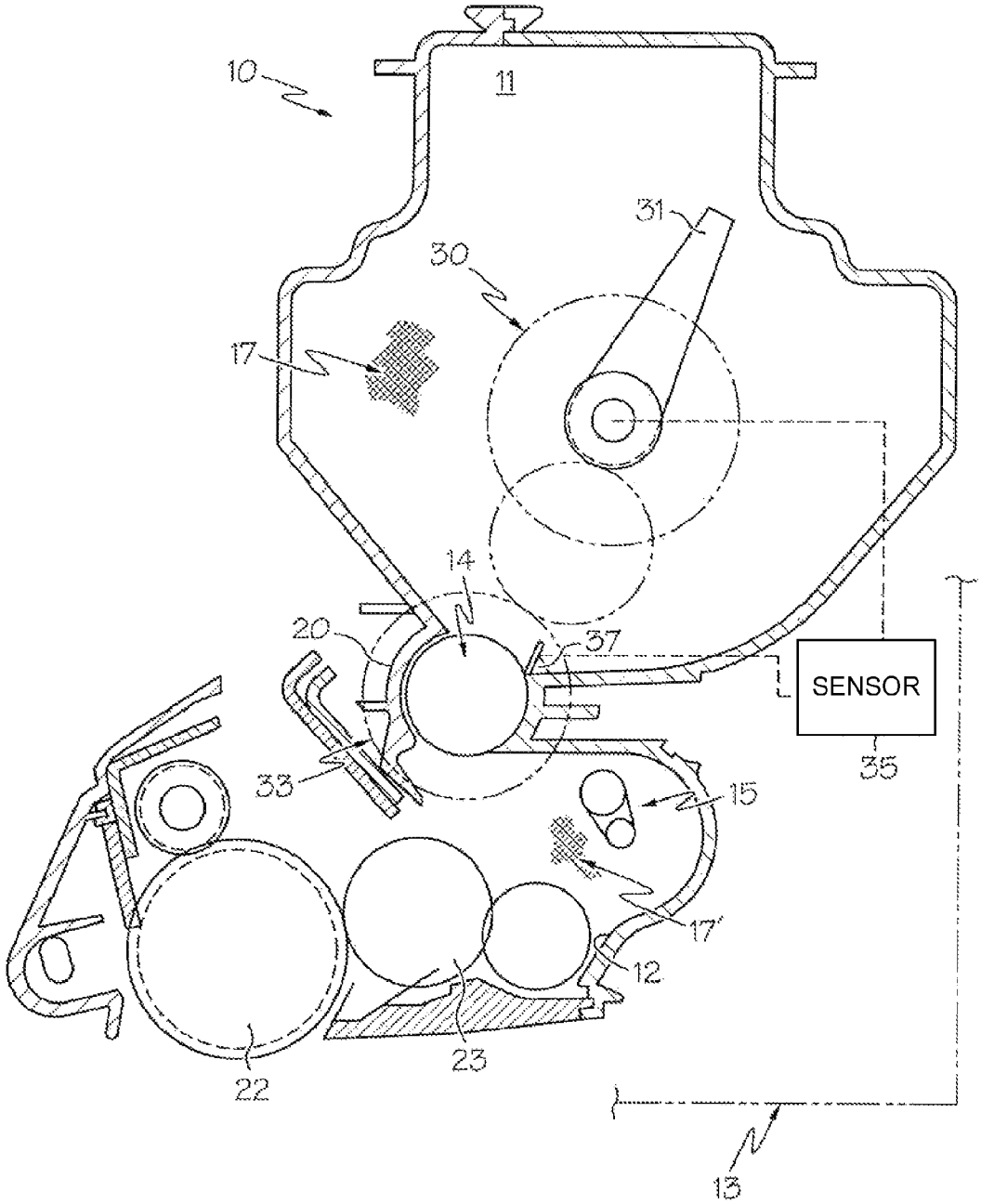
10
11
31
30
17
14
20
37
SENSOR
35
33
15
17'
12
22
23
13

TONER CONTAINER STRUCTURE AND METHOD FOR ASSESSING TONER CONSUMPTION IN AN IMAGE FORMING APPARATUS

BACKGROUND OF THE INVENTION

1. Field of the Invention

The present invention is directed to the field of image forming devices having a sensor for indicating toner level, and more particularly to a toner container structure and system for an image forming apparatus and method for assessing toner consumption as measured by the number of pixels printed by the image forming apparatus.

2. Description of the Related Art

Image forming devices including copiers, laser printers, facsimile machines, and the like, include a photoconductive drum having a rigid cylindrical surface that is coated along a defined length of its outer surface. The surface of the drum is charged to a uniform electrical potential and then selectively exposed to light in a pattern corresponding to an original image. The areas of the drum surface exposed to light are discharged and form a latent electrostatic image on the drum surface. A developer material, such as toner having an electrical charge, is attracted to the photoconductive drum surface and is used for forming the image. The toner is stored in a reservoir adjacent to the photoconductive drum and is transferred to the drum by the developer roll. The thickness of the toner layer on the developer roll is controlled by a nip, which is formed between the doctor blade and the developer roll. A recording sheet, such as a blank sheet of paper, is then brought into contact with the discharged photoconductive drum surface and the toner thereon is transferred to the recording sheet in the form of the latent electrostatic image. The recording sheet is then heated to permanently fuse the toner to the sheet.

Additional background information may be found by reference to U.S. Pat. No. 6,510,291 to Campbell et al, hereinafter referred to as the '291 patent, the entire teachings and contents of which are incorporated herein by reference.

Laser printers often include gas gages that indicate how much toner remains in the toner cartridges. Various existing methods to estimate how much toner has been consumed include optical, capacitive, torque-based, weight-based, vibration-based, and others. An inexpensive method simply counts the dots that the laser printer prints (pixels) and estimates the toner consumption from the pixels printed. The original toner minus the amount used to print the pixels indicates the amount of remaining toner. Though inexpensive, this pixel-counting method is highly inaccurate. The pixel counting itself can have errors if the printer uses complex algorithms to place sub-pixels on adjacent lines to smooth images. Also, the amount of toner consumed by any given pixel is not a constant, and is affected by variables such as temperature, humidity, wear of components, and manufacturing tolerances of components. Further, adjacent pixels may consume different amounts of toner, so the toner consumption is affected by what is printed, not just by the number of printed pixels.

Of the various algorithms that have been proposed to account for all variations in toner consumption by a pixel, most are complex and inaccurate. An inaccurate estimate of toner consumption per pixel inevitably leads to an inaccurate estimate of remaining toner cartridge life and possible premature toner depletion.

There is, therefore, a need for a toner container structure and method for accurately assessing toner level based on the number of printed pixels.

SUMMARY OF THE INVENTION

The present invention provides a toner container system (such as a toner cartridge) and method for determining the toner consumed by each pixel in an image forming apparatus, such as a printer, so to accurately assess the amount of toner remaining in the toner container. The pixels printed by the image forming apparatus (printer) are counted over a portion of toner container life when a known amount of toner is consumed, the rate of toner consumption per pixel is then calculated, and the calculated rate of toner consumption per pixel is used to determine the amount of toner remaining in the container.

The invention therefore relates to a toner container system for an image forming apparatus comprising, a first reservoir sized to contain a supply of toner;

a second reservoir for receiving toner from said first reservoir;

a toner transfer mechanism disposed between said first reservoir and said second reservoir for transferring of toner from said first reservoir to said second reservoir; and a sensor operatively interconnecting said image forming apparatus and said toner container system for counting the number of pixels printed by said image forming apparatus, calculating the rate of toner consumption per printed pixel when said first reservoir is emptied of toner, and calculating the toner remaining in said second reservoir based on the calculated rate of toner consumption per pixel.

The invention also relates to a toner container system for an image forming apparatus comprising, a first reservoir sized to contain a supply of toner;

a second reservoir for receiving toner from said first reservoir;

a toner transfer mechanism disposed between said first reservoir and said second reservoir for transferring toner from said first reservoir to said second reservoir;

a toner level sensing device within said second reservoir for activating said toner transfer mechanism to transfer toner from said first reservoir to said second reservoir when the toner level within said second reservoir drops to a preselected level; and a sensor operatively interconnecting said image forming apparatus and said toner container system for counting the number of pixels printed by said image forming apparatus, calculating the rate of toner consumption per printed pixel when said first reservoir is emptied of toner, and calculating the toner remaining in said second reservoir based on the calculated rate of toner consumption per pixel.

The invention further relates to a method for determining the amount of toner remaining in a toner container system in an image forming apparatus, wherein the toner container system includes a first reservoir sized to contain a supply of toner, a second reservoir for receiving toner from the first reservoir, and a toner transfer mechanism disposed between the first reservoir and the second reservoir for transferring toner from the first reservoir to the second reservoir, the method comprising the steps of, counting the number of pixels printed by said image forming apparatus;

calculating the rate of toner consumption per printed pixel when said first reservoir is emptied of toner; and calculating the toner remaining in said second reservoir based on the calculated rate of toner consumption per pixel.

An advantageous aspect of the invention resides in very little printer memory being required to count pixels. No complex pixel counting algorithms are needed to evaluate toner content of the container because the pixels are counted in the same way during the counting steps of the method as during the calculation steps, and errors are substantially averaged out. An accurate estimate of remaining toner is made regardless of the manner of printing because the rate of toner used per pixel is calculated during the consumption of a known mass of toner.

These and other attributes, aspects and advantages of the invention will become apparent as a detailed description of representative embodiments proceeds.

BRIEF DESCRIPTION OF THE DRAWINGS

Having thus described the invention in general terms, reference will now be made to the accompanying drawing FIGURE that is not necessarily drawn to scale, and that shows a sectional view of a toner container system according to the invention as disposed within and forming a part of an image forming apparatus.

DETAILED DESCRIPTION

The present invention will now be described more fully hereinafter with reference to the accompanying drawing FIGURE, in which some, but not all embodiments of the invention are shown. The invention may be embodied in many different forms and should not be construed as limited to the embodiments set forth herein; rather, these embodiments are provided so that this disclosure will satisfy applicable legal requirements.

Reference is now made to the Campbell et al '291 patent, the entire contents of which are incorporated herein, for a description of the basic elements and operation of the overall electrophotographic image forming process in a typical image forming apparatus utilizing a plurality of color cartridges. Specific reference is made to FIG. 1 of Campbell et al '291 and the accompanying text briefly describing the structure and operation of a four cartridge color laser printer as a non-limiting exemplar of image forming devices generally using toner for printing with a photoconductor.

Referring now to the accompanying drawing FIGURE, shown therein is a sectional view of a toner container 10 system having two reservoirs, namely a first upper reservoir 11 and a second lower reservoir 12. A toner transfer mechanism 14 is disposed within an intermediate region 20 between reservoir 11 and reservoir 12, and a toner level sensing device 15 is disposed within reservoir 12. In one aspect of the invention, container 10 may be structured to contain black toner for a black only image forming apparatus (such as a printer). More typically, however, container 10 may comprise one of a plurality of similarly structured containers, such as the various toner cartridges included in a color image forming apparatus, all of which cartridges are generally of similar construction but distinguished by the toner color contained therein. A typical color image forming apparatus may include individual cartridges including respective toner colors of black, magenta, cyan, and yellow, each respective color forming an individual image of a single color that is combined in layered fashion with the other colors to create the final multicolored image. Toner container 10 (and each of the other toner containers included in the image forming apparatus structured according to the invention) may include an image developer roller mechanism 23 that operatively contacts a photoconductive drum 22 within an image forming apparatus 13.

With reference again to the accompanying drawing FIGURE, reservoir 11 is a toner supply reservoir for containing (that is, initially charged with) a known amount of toner 17. It is desirable for the volume of reservoir 11 to be as large as practical so that a maximum number of images may be produced before toner 17 is exhausted, while maintaining container 10 at a size that does not result in a large overall size of image forming apparatus 13. Intermediate region 20 between reservoir 11 and reservoir 12 contains toner transfer mechanism 14 that provides a pathway for the transfer by toner transfer mechanism 14 of toner 17 from reservoir 11 to reservoir 12 during operation of image forming apparatus 13. In one embodiment of the invention, reservoir 12 may include a toner level sensing device 15 for sensing toner 17' level within reservoir 12 and activating toner transfer mechanism 14 to transfer toner 17 to reservoir 12 when the level of toner 17' drops below a preselected level setting. Reservoir 11 is normally disposed above reservoir 12 so that the transfer of toner 17 from reservoir 11 to reservoir 12 may be gravity assisted.

In one embodiment of the invention, movement of toner 17 from reservoir 11 to reservoir 12 is facilitated using geared toner supply mechanism 30 (shown in dashed lines) with attached paddle 31 within reservoir 11 for agitating and moving toner 17 into toner transfer mechanism 14. Paddle 31 may be sized to extend substantially the length of toner container 10 and to rotate closely to the walls of reservoir 11 so as to agitate and prevent clumping of toner 17, in manner more fully described in the Campbell et al '291 patent. Paddle 31 may otherwise be configured for the intended purpose as would occur to the skilled artisan practicing the invention. Metering mechanism 33 connects toner supply mechanism 30 with toner transfer mechanism 14 for moving toner 17 through intermediate region 20 to reservoir 12 with each movement (i.e. rotation) of toner transfer mechanism 14. The structure and operation of toner supply mechanism 30, toner transfer mechanism 14 and toner metering mechanism 33 may be substantially similar to that described in Campbell et al '291 incorporated by reference herein, or may be otherwise configured by one with skill in the applicable art to accomplish the desired toner transfer function, within the scope of these teachings and of the appended claims.

Toner sensor mechanism 15 may comprise substantially any structure for the intended purpose of monitoring toner 17' levels in reservoir 12, as would occur to the skilled artisan practicing the invention. By way of example, one such useful structure is described in FIGS. 5-8 and the accompanying text of the Campbell et al '291 patent incorporated herein by reference.

Sensor 35 operatively interconnects image forming apparatus 13 and container 10 to count the number of pixels printed by apparatus 13 up to the point when reservoir 11 is empty. This may be indicated when toner level sensing device 15 calls continuously for toner to be transferred, which indicates that reservoir 11 is empty because no toner is being delivered by toner transfer mechanism 14. Other devices or methods may be used within reservoir 11 to indicate when it is empty of toner, as would occur to the skilled artisan guided by these teachings, the specific selected device or method not considered limiting of the invention herein. For example, if toner transfer mechanism 14 were structured to transfer accurately a known discrete amount per delivery occurrence, the number of deliveries by toner transfer mechanism 14 could be counted to determine when reservoir 11 is empty. In this example, when the number of pixels printed per toner transfer occurrence decreases to a small number, very little toner is then being delivered by each transfer occurrence even though reservoir 12 is indicated as being low on toner; at that point, reservoir 11 is empty of toner.

Sensor 35 can be in the form of a microprocessor or other device configured for the intended purpose as would occur to the skilled artisan practicing the invention, the same not considered limiting of the invention or of the appended claims. In one aspect of the invention, sensor 35 comprises a microprocessor within the hardware and software of image forming apparatus 13 that reports the number of pixels printed on each page and adds the number of printed pixels for each successive page to tally the total number of pixels printed by each color container. This tally is kept either in the memory of image forming apparatus 13 or in a memory device on container 10. Switch 37 is operatively connected to sensor 35 and detects each transfer of toner 17 through toner transfer mechanism 14. In a non-limiting aspect of the invention switch 37 may be activated by the rotation of paddle 31 directly geared to toner transfer mechanism 14 through toner supply mechanism 30.

When all toner 17 has been transferred from reservoir 11 through toner transfer mechanism 14, sensor 35 divides the total number of pixels printed by the total mass of toner 17 that has been transferred. As suggested above, reservoir 11 is substantially empty when toner transfer mechanism 14 runs continuously. After reservoir 11 is empty, the toner remaining in reservoir 12 is then known, and the calculated rate of pixels printed per mass of toner consumed can be applied to project toner consumption for the remainder of toner container life by further pixel counting to determine when reservoir 12 will be exhausted of toner and correspondingly when the toner container must be replaced.

It is noted further that each toner container in an image forming apparatus having multiple toner containers (cartridges) each containing a respective toner color may be structured as described above for container 10.

Another aspect of the invention may be embodied in an image forming apparatus 13 wherein toner transfer mechanism 14 and lower reservoir 12 are structured as elements of the image forming apparatus itself In this arrangement, reservoir 11 containing the original charge of toner 17 may be insertable into apparatus 13 as a separate unit and operatively engage toner transfer mechanism 14 and metering mechanism 33 in substantially similar to the manner depicted in the accompanying drawing FIGURE.

The invention therefore provides a toner container system for an image forming apparatus and method for assessing toner consumption as measured by the number of pixels printed by the image forming apparatus. It is understood that the invention may be practiced in ways other than as specifically set forth herein without departing from the scope and essential characteristics of the invention. The description of several embodiments of the invention as herein presented is therefore intended for purposes of illustration. It is not intended to be exhaustive or to limit the invention to the precise forms disclosed, and obviously many modifications and variations are possible in light of the above teachings. It is intended that the scope of the invention be defined by the claims appended hereto.

We claim:

1. A toner container system for an image forming apparatus comprising:

(a) a first reservoir sized to contain a supply of toner;

(b) a second reservoir for receiving toner from said first reservoir;

(c) a toner transfer mechanism disposed between said first reservoir and said second reservoir for transferring toner from said first reservoir to said second reservoir; and (d) a sensor operatively interconnecting said image forming apparatus and said container system for counting a number of pixels printed by said image forming apparatus, calculating a rate of toner consumption per printed pixel when said first reservoir is emptied of toner, and calculating the toner remaining in said second reservoir based on the calculated rate of toner consumption per pixel.

2. The system of claim 1 wherein said sensor comprises a microprocessor.

3. The system of claim 1 further comprising a toner level sensing device within said second reservoir for activating said toner transfer mechanism to transfer toner from said first reservoir to said second reservoir when the toner level within said second reservoir drops to a preselected level.

4. The system of claim 1 further including a toner supply mechanism within said first reservoir for agitating said toner and moving said toner into said toner transfer mechanism.

5. The system of claim 4 wherein said toner supply mechanism includes a paddle positioned within said first reservoir.

6. The system of claim 1 wherein said first reservoir is positioned vertically above said second reservoir.

7. The system of claim 1 wherein said second reservoir operatively connects to said image forming apparatus for supplying toner thereto.

8. A toner container system for an image forming apparatus comprising:

(a) a first reservoir sized to contain a supply of toner;

(b) a second reservoir for receiving toner from said first reservoir;

(c) a toner transfer mechanism disposed between said first reservoir and said second reservoir for transferring toner from said first reservoir to said second reservoir;

(d) a toner level sensing device within said second reservoir for activating said toner transfer mechanism to transfer toner from said first reservoir to said second reservoir when the toner level within said second reservoir drops to a preselected level; and (e) a sensor operatively interconnecting said image forming apparatus and said container system for counting a number of pixels printed by said image forming apparatus, calculating the rate of toner consumption per printed pixel when said first reservoir is emptied of toner, and calculating the toner remaining in said second reservoir based on the calculated rate of toner consumption per pixel.

9. The system of claim 8 wherein said sensor comprises a microprocessor.

10. The system of claim 8 further including a toner supply mechanism within said first reservoir for agitating said toner and moving said toner into said toner transfer mechanism.

11. The system of claim 10 wherein said toner supply mechanism includes a paddle positioned within said first reservoir.

12. The system of claim 8 wherein said first reservoir is positioned vertically above said second reservoir.

13. The system of claim 8 wherein said second reservoir operatively connects to said image forming apparatus for supplying toner thereto.

14. A method for determining an amount of toner remaining in a toner container system in an image forming apparatus, wherein the toner container system includes a first reservoir sized to contain a supply of toner, a second reservoir for receiving toner from the first reservoir, and a toner transfer mechanism disposed between the first reservoir and the second reservoir for transferring toner from the first reservoir to the second reservoir, the method comprising the steps of, (a) counting a number of pixels printed by said image forming apparatus;

(b) calculating a rate of toner consumption per printed pixel after said first reservoir is emptied of toner; and (c) calculating the toner remaining in said second reservoir based on the calculated rate of toner consumption per pixel.

15. The method of claim 14 further comprising the step of sensing a toner level within said second reservoir and activating said toner transfer mechanism to transfer toner from said first reservoir to said second reservoir when the toner level within said second reservoir drops to a preselected level.

16. The method of claim 14 wherein the steps of counting the number of pixels, calculating the rate of toner consumption per pixel, and calculating the toner remaining in said second reservoir are performed using a microprocessor.

17. The method of claim 14 further including the step of agitating toner within the first reservoir for moving toner from the first reservoir into said toner transfer mechanism.

18. The method of claim 17 wherein the step of agitating toner is performed using a paddle positioned within said first reservoir.

19. The method of claim 14 wherein said first reservoir is positioned vertically above said second reservoir.

20. The method of claim 14 wherein said second reservoir operatively attaches to said image forming apparatus for supplying toner thereto.

* * * * *